United States Patent [19]

Weiss et al.

[11] Patent Number: 4,923,076

[45] Date of Patent: May 8, 1990

[54] CARGO CONTAINER APPARATUS WITH THERMALLY EXPANDING PANELS

[75] Inventors: Dale F. Weiss, Hermosa Beach; Ariel Neustadt, Lomita, both of Calif.

[73] Assignee: Air Cargo Equipment Corporation, Rancho Dominquez, Calif.

[21] Appl. No.: 281,668

[22] Filed: Dec. 9, 1988

[51] Int. Cl.[5] ..... B65D 87/00

[52] U.S. Cl. ..... 220/1.5; 220/77; 220/80

[58] Field of Search ..... 220/75, 77, 80, 1.5

[56] References Cited

U.S. PATENT DOCUMENTS

| | | | |
|---|---|---|---|
| 1,054,106 | 2/1913 | Galbally | 220/80 |
| 2,165,901 | 6/1939 | Merk | 220/75 |
| 2,288,396 | 6/1942 | Fyans | 220/75 |
| 2,364,083 | 12/1944 | Lindsay | 220/80 |
| 2,522,097 | 9/1950 | Cookson | 220/75 |
| 2,673,659 | 3/1954 | Moore | 220/80 |
| 3,226,008 | 12/1965 | Chiorri | 220/80 |
| 3,306,487 | 2/1967 | Gregoire | 220/1.5 |
| 4,107,826 | 8/1978 | Tysdal | 24/243 |
| 4,212,406 | 7/1980 | Mittelmann | 150/0.5 |
| 4,694,543 | 9/1987 | Conley | 24/460 |
| 4,795,047 | 1/1989 | Dunwoodie | 220/1.5 |

FOREIGN PATENT DOCUMENTS

| | | | |
|---|---|---|---|
| 914091 | 6/1946 | France | 220/75 |

*Primary Examiner*—Stephen Marcus
*Assistant Examiner*—Stephen Castellano
*Attorney, Agent, or Firm*—Fulwider, Patton, Lee & Utecht

[57] ABSTRACT

A cargo container apparatus constructed of panels joined to a rigid framework so as to allow quick assembly and replacement of damaged panels without the use of conventional fasteners. In addition, the panels can undergo unrestricted expansion and contraction thereby allowing polycarbonate panels to be affixed to a rigid aluminum framework for use in environments experiencing a wide range of temperatures. This system is especially well-suited for the construction of air cargo containers.

12 Claims, 3 Drawing Sheets

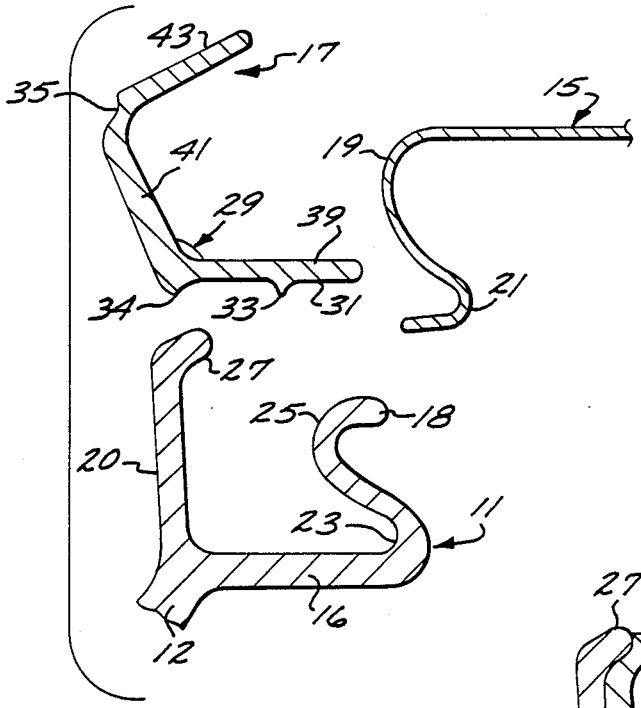
FIG. 2
FIG. 3
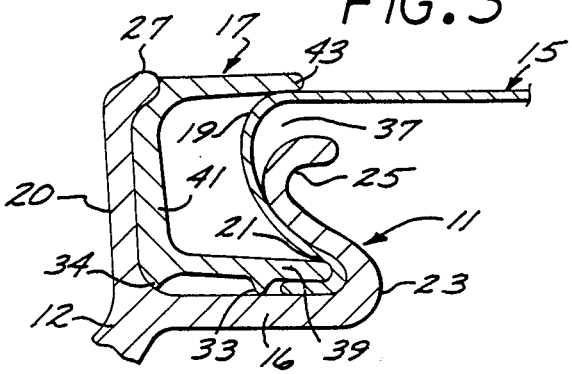
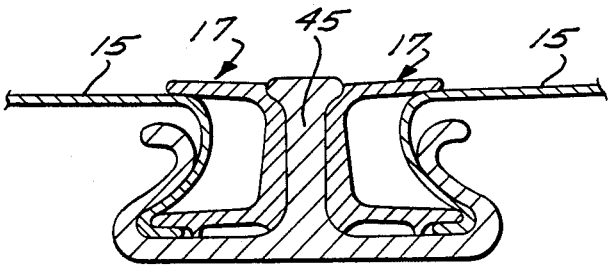
FIG. 4

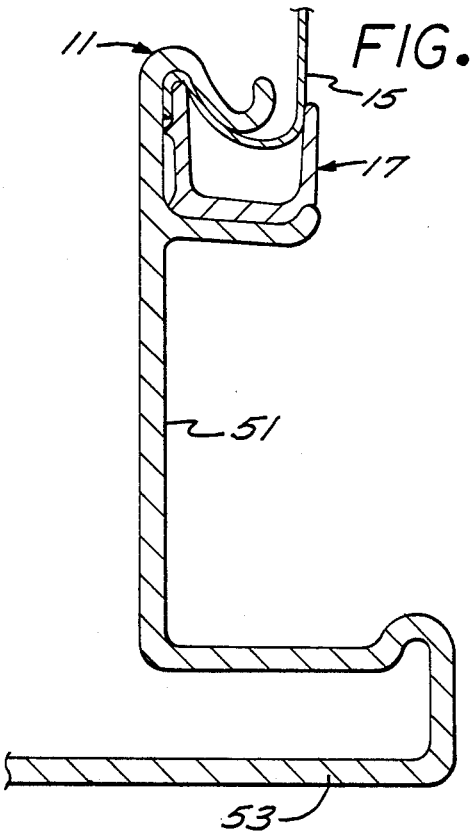
FIG. 5
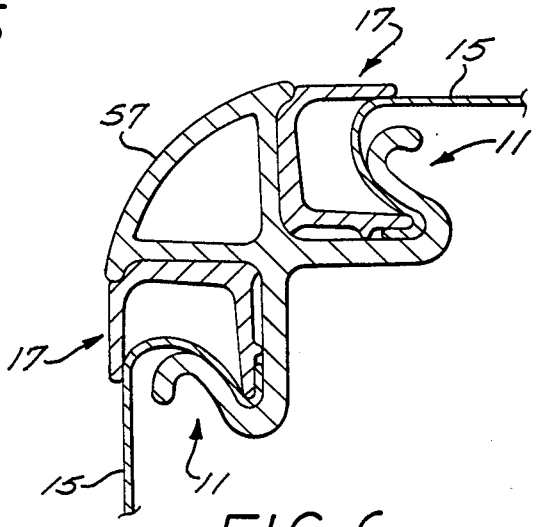
FIG. 6
FIG. 7
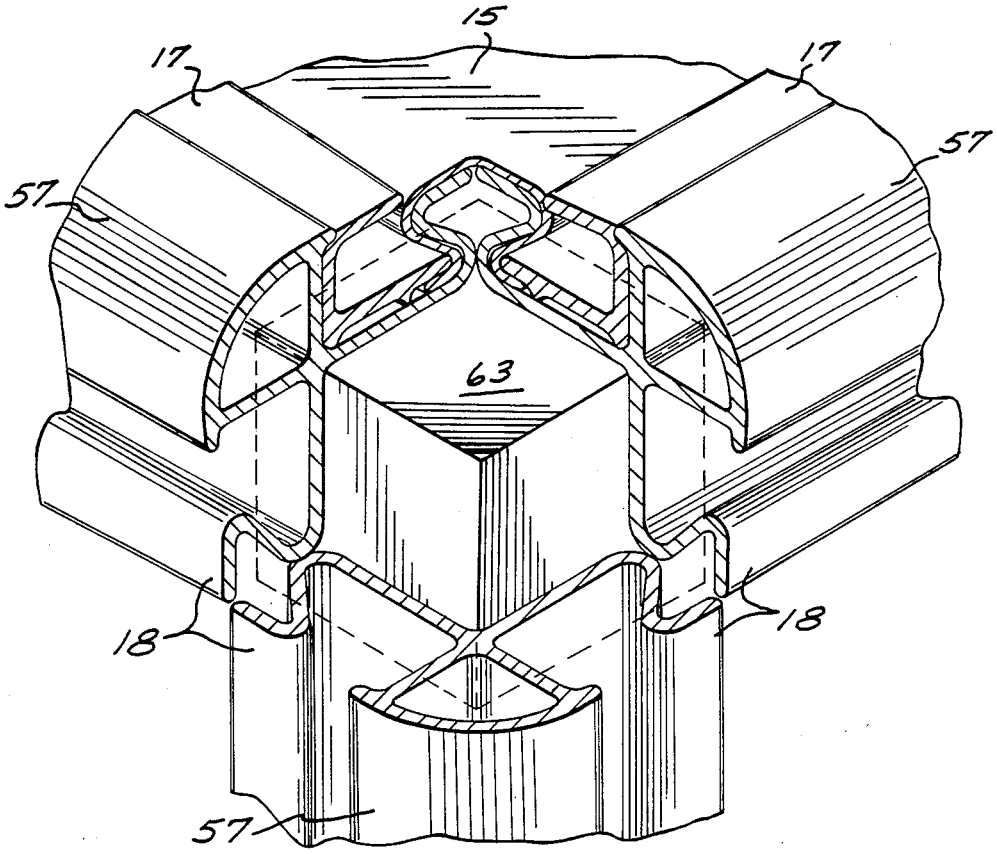

CARGO CONTAINER APPARATUS WITH THERMALLY EXPANDING PANELS

BACKGROUND OF THE INVENTION

This invention relates generally to a method of construction, and more particularly relates to an improved system for joining highly durable panels to a rigid framework for use in an environment subject to a wide range of temperatures. Such a system is particularly well suited for joining polycarbonate panels to an aluminum framework in the construction of air cargo containers.

The manufacture of air cargo containers epitomizes the need for a method of construction that yields a strong and durable yet lightweight structure and one that can quickly and easily be repaired. Such containers have heretofore been typically constructed of aluminum. Aluminum sheet material riveted to an aluminum frame provides a relatively lightweight and strong structure. However, aluminum dents easily and the repair of such a structure calls for the labor intensive removal and subsequent replacement of all the fasteners with which the damaged panel is affixed to the frame. A unibody design of molded plastic material has been an alternative approach, although it suffers from shortcomings in its durability and repairability. A further reduction in weight of any such structure is a continually welcomed improvement.

The superior weight and strength characteristics of polycarbonates suggest that the use of such materials in the construction of air cargo containers would be a most advantageous adaptation. Affixation of polycarbonate panels to a rigid aluminum frame can provide a structure that is extremely light, strong and durable. An inherent disadvantage of such a construction is a direct result of the high coefficient of thermal expansion of the polycarbonate and more particularly, it is the large difference between the coefficient of thermal expansion of the polycarbonate relative and the coefficient of thermal expansion of the aluminum framework that causes difficulties. Conventional fastening means are ill-suited for interconnecting these two types of materials when they are to be cycled through wide temperature ranges. An air cargo container typically encounters temperatures from about −40° F. to 160° F., a range which imparts highly disproportionate amounts of dimensional changes to such a structure. Just a few cycles through such temperature extremes leads to fatigue and failure of a conventionally assembled polycarbonate and aluminum structure. Failures are typically manifested by hole fracture as the expanding and contracting panels repeatedly strain against the screws, bolts or rivets with which the panels are fastened to the rigid aluminum frame. In addition to the failure problems resulting from the affixation of such panels to the framework using conventional fastening means, replacement of damaged panels is a rather labor intensive operation.

SUMMARY OF THE INVENTION

The general purpose of this invention is to provide a method of construction whereby full advantage can be taken of the high strength and low weight characteristics of polycarbonate materials in the construction of air cargo containers. More particularly the method of construction provides a system for enclosing a rigid framework with polycarbonate panels wherein the polycarbonate panels are fastened to the framework in such a manner so as to minimize the deleterious effects of the high coefficient of thermal expansion of the polycarbonate materials while the structure is cycled through wide temperature ranges. The system employs a snap-in fastening system to thereby obviate the need for substantial labor efforts in the initial assembly and subsequent repair of the structures.

The system of the present invention requires the construction of a rigid framework incorporating extruded aluminum frame channels having a somewhat U-shaped cross section. Polycarbonate panels having specially formed flexible edge profiles are then hooked into the complementarily shaped channels after which a semi-rigid clamping rail is simply snapped into each receiving channel accomodating an edge of the polycarbonate panel. Movement resulting from subsequent expansion and contraction of the polycarbonate panel is then absorbed in the flexible edge profiles to avoid inducement of harmful stresses. Expansion of the panel relative to the rigid framework may induce a slight bowing of the entire panel while contraction of the entire panel simply causes the slack to be taken up in the special edge profile without causing strain against any fastening means.

In the event a panel is damaged and requires replacement, the clamping rails affixing the panel to the framework are simply snapped out to free the panel edges to allow disengagement from the receiving channels. Installation is the reverse of removal and can be accomplished in a most expeditious manner.

BRIEF DESCRIPTION OF THE DRAWINGS

Other objects and many of the attendant advantages of this invention will be readily appreciated as the same becomes better understood by reference to the following detailed description when considered in conjunction with the accompanying drawings in which like reference numerals designate like parts throughout the figures, thereof and wherein:

FIG. 2 is an exploded cross-sectional view of a modification of the container apparatus of the present invention;

FIG. 3 is a cross-sectional view, similar to FIG. 2 but showing the components in an assembled state;

FIG. 4 is a cross-sectional view, in enlarged scale, along the lines 4—4 of FIG. 1;

FIG. 5 is a cross-sectional view of further modifications of the container apparatus of the present invention;

FIG. 6 is a cross-sectional view, in enlarged scale, along the lines 6—6 of FIG. 1; and FIG. 7 is a detailed perspective cut-back view in enlarged scale of the circle 7 in FIG. 1.

DETAILED DESCRIPTION OF THE EMBODIMENTS

Figure 1:
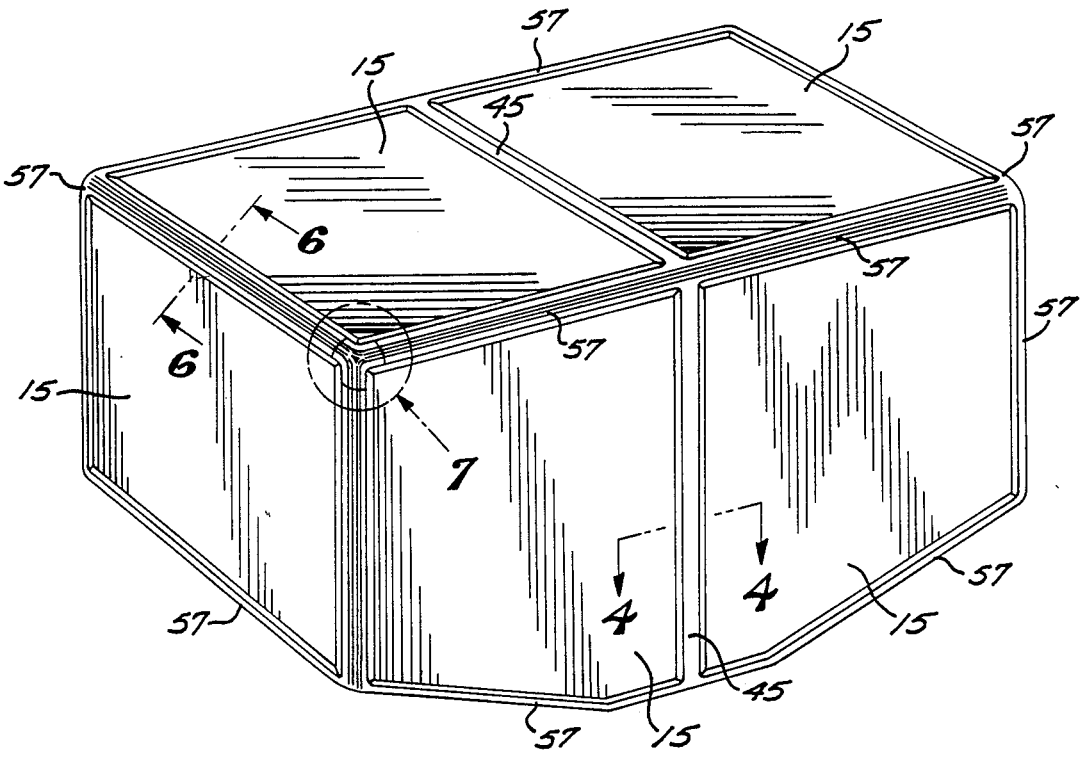
FIG. 1 is a perspective view of an air cargo container embodying the container apparatus of the present invention.

Referring to FIG. 1, the container apparatus of the present invention includes, generally, a plurality of substantially flat panels 15 mounted in a rigid framework by means of expansion joints. The present system enables lightweight polycarbonate panels to be joined to a rigid aluminum framework to yield an extremely light but strong and durable structure. In addition, the system of the present invention allows a particular panel to be quickly and easily replaced.

FIGS. 2 and 3 illustrate in more detail how the panels 15 and the framework generally designated reference numeral 12 interact to enable a joining of polycarbonate material with a high coefficient of thermal expansion to a rigid aluminum framework having a significantly lower coefficient of thermal expansion.

The rigid framework 12 incorporates receiving channels 11 configured with an open side for receipt of the specially formed edges of the panels 15. Clamping rails 17 are configured and sized to snap into place within the receiving channels 11 to quickly and positively lock the panels into place. This system allows the panels to freely expand and contract without inducing strain at their interface with the rigid framework.

Referring to FIG. 2, the receiving channel 11 is formed in cross section with a modified U-shape to form a straight bottom wall 16 and oppositely disposed front and back walls 18 and 20, respectively. The front wall 18 curves back over the front extremity of the bottom wall 16 to form an inwardly turned curve 23 and then turns upwardly and outwardly to form an outwardly turned retainer curve 25 to thus exhibit a generally S-shape. The upstanding back wall 20 is turned inwardly at its upper extremity to form a forwardly angled retaining lip 27 spaced from the retainer curve 25 to form an elongated opening. The receiving channel is constructed of relatively rigid material, as for example aluminum, to thus afford the necessary rigidity while being relatively light weight and inexpensive and easy to machine.

The panel 15 is formed along its marginal edges with a modified S-shaped configuration to form a relatively large radius of curvature proximal curve 19 defining a hook which curves back under the plane of the panel and a relatively small radius of curvature curve 21 which terminates in flange 22. Referring to FIG. 2, for reasons that will become more apparent hereinafter, the radius of curvature of the distal curve 21 of the edge profile of the panel 15 is selected to be substantially equivalent to the proximal radius 23 of curvature of the front wall 18 of the receiving channel. The radius of curvature of the proximal curve 19 of the panel edge profile is however formed to be larger than the distal radius of curvature 25 of the front wall 18 of the receiving channel to thus afford freedom for flexing thereof. A preferred type of polycarbonate material for use in this application is marketed under the trade designation Lexan by General Electric Corp. Such a panel having a thickness of 0.060 inch provides comparable performance to the prior art aluminum panels of 0.032 inch thickness with an approximate weight savings of 18%.

With continued reference to FIGS. 2 and 3, the clamping rail 17 is preferably constructed of resilient material such as Noryl EN185. Such rail is formed in cross-section with a generally open C-shape by incorporation of an obtuse angle at 29 and includes a back wall 41 having a trapping leg 39 projecting laterally from the bottom side thereof and a cover leg 43 projecting laterally from the top side thereof. The dimensions of the clamping rail 17 are selected such that the width of the trapping leg 39 substantially corresponds to the dimension between the back wall 20 of the receiving channel 11 and the inside of the distal curve 21 in the panel 15 as viewed in FIG. 3. Such clamping rail is formed on its underside with a pair of spaced apart ribs 33 and 34 which project downwardly a distance corresponding with the thickness of the panel 15 to thus act as spacers which space such trapping leg 39 off the bottom wall 16 of the channel 11.

The back wall 41 of the clamping rail 17 is formed at its top extremity with an outwardly opening groove 35 spaced vertically from the bottom extremities of the ribs 33 and 34, a distance corresponding with the distance the retaining lip 27 is spaced above the top surface of the bottom wall 16 of the channel 11 to thus nestingly receive such lip and cooperate therewith to lock the rail in position. The cover leg 43, when the rail 17 is in its clamping position, projects forwardly from the back wall 41 a distance sufficient to project over the proximal curve 19 (FIG. 3) to thus engage the planar surface of the panel 15 to cooperate therewith in closing off the interior of the channel 11.

In operation a rigid framework is first constructed using various frame members incorporating the appropriate receiving channel profiles 11. These channels are joined at their ends by conventional means and may incorporate such features as pivoting door members and sturdy base platforms. Once this framework has been constructed the panels 15 formed in appropriate dimensions having the S-shaped edge profile described above are fitted into the corresponding receiving channels structure. It will be appreciated that this step is achieved, for instance, by merely lowering the distal curve 21 (FIG. 2) into the receiving channel 11 to nest it within the confines of the curve 23 as shown in FIG. 3. Although the polycarbonate panel is rigid there is enough give for the edge to be twisted to insertion into the receiving channel. Once in place the semi-rigid clamping rails 17 are manually snapped into place without the use of hand tools. Such rails are positioned into place by inserting the trapping leg 39 into the panel curve 21 as pre-assembled in the channel 11 to nest the free end thereof in the interior radius thereof (FIG. 3). It will be appreciated that as such trapping leg 39 is maneuvered into position proximate the bottom wall 16, the ribs 33 and 34 will act as spacing ribs to cooperate with the terminal flange 22 of the panel 15 to stabilize such leg. By then pressing downwardly on the free end of the cover leg 43 the back wall 41 will be flexed to assume a right angle relative to the leg 39 to thus provide for such rail to be snapped into the position shown in FIG. 3 with the retaining lip 27 received in the groove 35 to hold such rail snugly in position trapping the distal curve 21 securely against the inside radius of the curve 23. The resultant structure thus assembled affords an extremely lightweight and durable container especially adaptable for use in transporting air freight when weight is an important factor.

In use, it will be appreciated that the container will be exposed to the extreme cold experienced in the hold of a cargo plane when at high altitudes. This will result in contraction of the polycarbonate panel 15 while the rigid aluminum framework remains relatively unaffected. Such contraction of the panels 15 is accommodated by the fact that the proximal curve 19 (FIG. 3), being of a substantially greater radius of curvature than the retaining channel curve 25, provides for free flexing thereof to the full extent allowed by the gap 37 formed between such curves. Conversely, as higher temperatures are experienced, such as for example, while the air cargo container sits in the sun in an airport located in a hot climate, the polycarbonate panel 15 expands, and without inducing any strain at any points in the structure, the panel is free to simply bow outwardly or inwardly.

Because the polycarbonate material is free to expand and contract, the structure as a whole is not subjected to degradation as numerous such cycles are experienced throughout the service life of such a structure. In addition, the system of the present invention allows replacement of damaged panels to quickly and easily be accomplished. In order to remove a damaged panel, the leg 43 of the clamping rail 17 may be engaged and forced forwardly away from the back wall 20 of the channel 11 to shift the groove 35 clear of the retaining lip 27. No laborious drilling out of rivets or removing of screws, bolts or other fasteners is required. Once the clamping rail 17 has been removed, the edge of the panel 15 is free to be disengaged and flexed clear of the receiving channel 11. A new panel may then be installed in the reverse sequence.

FIGS. 4 through 6 illustrate various configurations in which the receiving channel 11 may be incorporated in a framework's structural members. For example, FIG. 4 illustrates a configuration in which panels 15 are joined end to end using the single retaining channel extrusion 45 which incorporates two receiving channel configurations placed back to back. Such a configuration is employed in the centrally located side and top frame members illustrated in FIG. 1.

FIG. 5 illustrates a heavy base portion frame member, for example one by which the entire air cargo container may be lifted, wherein the receiving channel 11 configuration is incorporated in the top edge of such an extrusion. The downwardly extending portion 51 elevates the polycarbonate panels out of harm's way while the base 53 provides a sturdy understructure by which the entire structure is supported and can be lifted as by a forklift.

FIG. 6 illustrates an edge member which allows two panels to be attached at an angle of 90° relative to one another. This configuration is employed throughout the edges of the structure illustrated in FIG. 1.

FIG. 7 is a perspective illustration of the corner of a partially assembled structure incorporating the joining system of the present invention. More particularly, the figure illustrates the intersection of three of the receiving channel profiles of FIG. 6 at a corner of the structure of FIG. 1. A corner member 63 allows attachment thereto of three such 90 joining members 57 in a mutually perpendicular configuration, each clamping rail being affixed to the corner member by conventional means, i.e., rivets, screws, or bolts. The two edges of the polycarbonate panel 15 are shown inserted into two of the receiving channels of the edge members 57, and are firmly held in place by clamping rails 17. A corner finishing fitting (not shown) attached to corner member 63 serves to bring all three planes to a smooth finished corner.

From the foregoing it will be appreciated that the cargo apparatus of the present invention provides an economical, convenient and effective means for joining materials having substantially different coefficient of thermal expansion so that advantage may be taken of the lightweight strength of, for instance, an aluminum frame and the advantages of lightweight shatterproof polycarbonate panels. The joint formed by the S-shaped configuration of the receiving channel and marginal extremity of the panels affords continuous clamping pressure once installation has been made to thus avoid irritating and dangerous vibration between the panels and frame members.

The panel joint in effect serves to seal the connection between the panel and frame to afford weather tight construction to protect the cargo from the elements.

The panels may be easily removed and replaced from time to time. The joint itself will accommodate varying thicknesses of panel construction thus removing any critical characteristics in the panel thickness.

Many modifications and variations of the present invention are possible in light of the above teachings and it is therefore to be understood that within the scope of the appended claims the invention may be practiced otherwise than is specifically described.

What is claimed is:

1. Cargo container apparatus comprising:

a container frame including elongated frame members formed of material of a predetermined coefficient of thermal expansion, at least one frame member including a retaining channel formed in cross section with back, bottom and front walls cooperating to form a cavity, said front wall projecting from the front edge of said bottom wall and turning backwardly thereover to form a retainer terminating in a free extremity spaced from said back wall to cooperate therewith in forming an elongated opening;

a plurality of resilient planar wall panels for spanning between said frame members and constructed of a material having a coefficient of thermal expansion greater than said predetermined coefficient of thermal expansion, at least one of said panels being formed along a marginal extermity thereof to turn out of and back over the plane of the body of the one panel to form a proximal panel curve for inserting through said opening to be received in said cavity and hook over said retainer, said proximal panel curve being configured to, when at a predetermined intermediate temperature, hook loosely over said retainer and leave a contraction space therebetween and to then extend along the interior surface of said front wall, said marginal extermity then being turned back on itself to form a distal panel curve terminating in a clamping flange disposed in overlying relationship over said bottom wall; and at least one clamping rail sized and configured to be received through said opening to be disposed in close fitting relationship with the interior of said cavity to be trapped between said back wall and said clamping flange to clamp said flange in place, whereby cooling of said container below said intermediate temperature causes at least one of said panels to contract relative to the container frame to thereby take up the contraction space between said proximal panel curve and said retainer.

2. The cargo container apparatus of claim 1 wherein:

said proximal panel curve and said distal panel curve formed in said marginal extremity of at least one of said panels, describes, in cross section, an S-shape.

3. The cargo container apparatus of claim 2 wherein:

said front wall of said retaining channel is formed a proximal retainer curve and a distal retainer curve describing in cross section an S-shape substantially complementing the S-shape of the panel's marginal extremity.

4. The cargo container apparatus of claim 3 wherein:

a radius of curvature of the panel's proximal curve and a radius of curvature of the distal curve of the front wall are slightly mismatched to form said contraction space therebetween when at said predetermined intermediate temperature.

5. The cargo container apparatus as set forth in claim 1 wherein:

said back wall of said retaining channel terminates with a retaining lip bent toward said retainer; and said clamping rail is formed with a back wall and laterally projecting trapping leg configured to, when received in said cavity be disposed, respectively, in overlying relationship with the retaining channel's back wall and bottom wall, with the top extermity of said clamping rails back wall engaged with said retaining lip and the free extremity of said trapping leg overlying said clamping flange.

6. The cargo container apparatus as set forth in claim 1 wherein:

said retainer is formed with a predetermined radius of curvature; and said proximal panel curve is formed with a radius of curvature greater than said predetermined radius of curvature.

7. The cargo container apparatus as set forth in claim 1 wherein:

said front wall is formed in cross section with a generally S-shape forming a first curve proximate said bottom wall and a second curve distal thereto to define said retainer, said S-shape having respective first and second radii of curvature; and said marginal extermity being formed in cross section with a generally S-shape, the distal panel curve thereof being formed, when said panel is at said predetermined intermediate temperature, with a radius of curvature substantially corresponding with the radius of curvature of said first curve and the proximal panel curve thereof being formed with a radius of curvature larger than the radius of curvature of said second curve to provide a gap between the proximal panel curve and the second front wall curve.

8. The cargo container apparatus as set forth in claim 1 wherein:

said frame is constructed of aluminum; and said panels are constructed of a polycarbonate.

9. The cargo container apparatus as set forth in claim 1 wherein:

said panels are constructed of polycarbonate.

10. The cargo container apparatus as set forth in claim 1 wherein:

said clamping rail is generally C-shaped in cross section to form a back wall having, in its free configuration, a trapping leg projecting laterally from one end of said back wall and a cover leg projecting laterally from the opposite end thereof, said trapping leg being so sized and configured as to be received in close fitting relationship between said back wall of said retaining channel and the marginal extremity of said panel as it extends along said interior surface of said front wall.

11. The cargo container apparatus as set forth in claim 10 wherein:

said trapping leg is formed on its side confronting said bottom wall, with at least one spacing rib spaced from the free end thereof and corresponding in height with the thickness of said clamping flange, to thus engage said bottom wall to cooperate with said clamping flange in stabilizing said clamping rail in said retaining channel.

12. The cargo container apparatus as set forth in claim 11 wherein:

said first mentioned back wall is formed at its free extremity with a retaining lip bent toward said retainer; and said second mentioned back wall is formed at its extremity opposite said trapping leg with an outwardly opening groove so configured and located as to, when said clamping rail is received in said cavity, be engaged by said retaining lip.

* * * * *